US009991602B2

(12) United States Patent
Wu et al.

(10) Patent No.: US 9,991,602 B2
(45) Date of Patent: Jun. 5, 2018

(54) FREQUENCY REFLECTING UNIT

(71) Applicant: NATIONAL TAIWAN UNIVERSITY, Taipei (TW)

(72) Inventors: Tzong-Lin Wu, Taipei (TW); Yi-Min Yu, New Taipei (TW)

(73) Assignee: NATIONAL TAIWAN UNIVERSITY, Taipei (TW)

( * ) Notice: Subject to any disclaimer, the term of this patent is extended or adjusted under 35 U.S.C. 154(b) by 342 days.

(21) Appl. No.: 14/661,053

(22) Filed: Mar. 18, 2015

(65) Prior Publication Data

US 2017/0040707 A1 Feb. 9, 2017

(30) Foreign Application Priority Data

Oct. 27, 2014 (TW) ..... 103136981 A

(51) Int. Cl.

| | |
|---|---|
| ***H01Q 15/00*** | (2006.01) |
| *H01Q 17/00* | (2006.01) |
| *H01Q 1/52* | (2006.01) |
| *H01Q 1/42* | (2006.01) |

(52) U.S. Cl.

CPC ..... *H01Q 15/0026* (2013.01); *H01Q 15/0013* (2013.01); *H01Q 15/0053* (2013.01); *H01Q 1/425* (2013.01); *H01Q 1/52* (2013.01); *H01Q 17/008* (2013.01)

(58) Field of Classification Search

CPC ..... H01Q 15/0006; H01Q 15/0013; H01Q 15/002; H01Q 15/0026; H01Q 15/0053; H01Q 15/006; H01Q 15/0066; H01Q 15/008; H01Q 15/0086; H01Q 15/0093; H01Q 1/425; H01Q 1/52; H01Q 17/008

USPC ..... 342/1, 2, 3, 4

See application file for complete search history.

(56) References Cited

U.S. PATENT DOCUMENTS

2005/0146402 A1* 7/2005 Sarabandi ..... H01P 1/2005 333/219

2009/0079637 A1* 3/2009 Fukui ..... H01Q 1/241 343/700 MS

FOREIGN PATENT DOCUMENTS

TW I318851 B 12/2009

TW I333829 B 11/2010

OTHER PUBLICATIONS

Chuen-De Wang, et al., "Bandwidth Enhancement Based on Optimized Via Location for Multiple Vias EBG Power/Ground Planes", IEEE Transactions on Components, Packaging and Manufacturing Technology, pp. 332-340, vol. 2, No. 2, Feb. 2012.

Ku-Teng Hsu, et al., "Design of Reflectionless Vias Using Neural Network-Based Approach", IEEE Transactions on Advanced Packaging, pp. 211-218, vol. 31, No. 1, Feb. 2008.

* cited by examiner

*Primary Examiner* — Robert Karacsony

(74) *Attorney, Agent, or Firm* — Li&Cai Intellectual Property (USA) Office

(57) ABSTRACT

A frequency reflecting unit is provided. The frequency reflecting unit is used as a portion of a frequency reflector. The frequency reflecting unit with a three-dimensional structure includes a metal pattern and at least one via. The metal pattern is disposed on a metal layout layer defined on one side of the frequency reflecting unit. One end of the via is disposed corresponding to the metal pattern. The via forms a non-zero angle with the metal layout layer. The other end of the via is an open circuit.

16 Claims, 16 Drawing Sheets

FREQUENCY REFLECTING UNIT

BACKGROUND

1. Technical Field

The present invention generally relates to a frequency reflecting unit, more particularly, to a frequency reflecting unit having a three dimensional structure.

2. Description of Related Art

A frequency reflector is generally used on an elliptical dish antenna reflector, and may be designed to have band-stop frequencies covering a wide frequency range. The frequency reflector is applicable to radars on the ground or missiles in the air to shield the antennas installed on the radars or the missiles from most of the electromagnetic waves to protect the antennas from being interfered with by environmental noise.

Conventionally, the frequency reflector is implemented by a metal radome, which is applicable to airplanes, missiles, and navigation. However, since the metal radome is too large in size, the frequency reflector based on the metal radome is not suitable for use in portable electronic apparatuses. Therefore, a frequency reflector including the metal pattern and a dielectric substrate has been provided. On the positive side or the back side of at least one layer in the dielectric substrate are disposed periodically arranged metal patterns, for example, a cross-shaped or U-shaped metal pattern.

The frequency characteristics of the frequency reflector depend on the interactions between the periodically arranged metal patterns and electromagnetic waves. Thus, the frequency reflector exhibits excellent selectivity with respect to the electromagnetic waves within the band-pass frequencies, while reflecting the electromagnetic waves within the band-stop frequencies. Since band-pass filters can selectively filter out undesired noise, band-pass filters are widely used in electromagnetic interference (EMI) protection.

In the prior art, to lower the band-pass frequencies and the band-stop frequencies for the frequency reflector, a capacitor or an inductor is required to be attached onto the two-dimensional surface of the frequency reflector. In other words, the attachment of a capacitor or an inductor to lower the band-pass frequencies leads to an increased area of the frequency reflector that limits the applications of the frequency reflector. Therefore, there is a need to provide a frequency reflector without increasing the area, while lowering the band-pass frequencies and the band-stop frequencies for the frequency reflector.

SUMMARY

One embodiment of the present invention provides a frequency reflecting unit with a three-dimensional structure. The spatial filter unit is used as a portion of a frequency reflector. The frequency reflecting unit includes a metal pattern and at least one via. The metal pattern is disposed on a metal layout layer defined on one side of the frequency reflecting unit. One end of the via is disposed corresponding to the metal pattern. The via forms a non-zero angle with the metal layout layer. The other end of the via corresponding to the metal pattern is an open circuit.

One embodiment of the present invention provides a frequency reflecting unit with a three-dimensional structure used as a portion of a frequency reflector. The frequency reflecting unit includes a metal pattern, a metal back plate and at least one via. The metal pattern is disposed on a metal layout layer defined on one side of the frequency reflecting unit. The metal back plate is disposed on the other side of the frequency reflecting unit opposite to the metal layout layer. One end of the via is disposed corresponding to the metal pattern. The via forms a non-zero angle with the metal layout layer. The other end of the via corresponding to the metal pattern is an open circuit.

One embodiment of the present invention provides a frequency reflecting unit with a three-dimensional structure used as a portion of a frequency reflector. The frequency reflecting unit includes a three-dimensional metal pattern. The three-dimensional metal pattern is disposed on a metal layout layer defined on one side of the frequency reflecting unit. A portion of at least one metal conductor extends outwards to a periphery of the metal layout layer and is an open circuit. The at least one metal conductor forms a non-zero angle with the metal layout layer.

As stated above, one embodiment of the present invention provides a frequency reflecting unit. In the frequency reflecting unit, the via forms a non-zero angle with the corresponding metal layout layer so that the frequency reflecting unit has a three-dimensional structure. A plurality of frequency reflecting units are periodically arranged to form a frequency reflector. Since an equivalent capacitor and an equivalent inductor are induced between the vias of neighboring frequency reflecting units, no additional capacitors and inductors are required on the two-dimensional surface of the frequency reflector to lower the band-pass frequencies and the band-stop frequencies for the frequency reflector. Compared to the currently available frequency reflectors, the frequency reflector in one embodiment of the present invention exhibits lowered the communication frequencies for the frequency reflector without needing a large area.

Furthermore, in the frequency reflecting unit with a three-dimensional metal pattern, a portion of at least one metal conductor of the three-dimensional metal pattern extends outwards to the metal layout layer and the metal conductor forms a non-zero angle with the metal layout layer. Similarly, an equivalent capacitor and an equivalent inductor are induced between the three-dimensional metal patterns of neighboring frequency reflecting units, no additional capacitors and inductors are required on the two-dimensional surface of the frequency reflector to lower the band-pass frequencies and the band-stop frequencies for the frequency reflector.

Furthermore, the metal pattern of the frequency reflector exhibits different reflection and transmission characteristics with respect to different angles and different frequencies of incident electromagnetic waves. When electromagnetic waves with different incident angles are within the band-pass frequencies for the metal pattern, total transmission occurs for the selected frequency range. On the contrary, when electromagnetic waves with different incident angles are within the band-stop frequencies for the metal pattern, the incident electromagnetic waves are totally reflected. Thus, the band-pass frequencies of the frequency reflector can be adjusted by designing the metal pattern of the frequency reflector so as to prevent the electronic apparatus circuitry from being interfered with by environmental noise.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood that the same or equivalent functions may be accomplished by different embodiments that are also intended to be encompassed within the scope of the present disclosure.

While such terms as "first," "second," etc., may be used to describe various components, such components must not be limited to the above terms. The above terms are used only to distinguish one component from another. For example, a second component may be referred to as a first component within the scope of the present invention, and similarly, the first component may be referred to as the second component. As used herein, the term "and/or" includes any and all combinations of one or more of the associated listed items.

(Embodiment of Frequency Reflector)

Figure 1A:
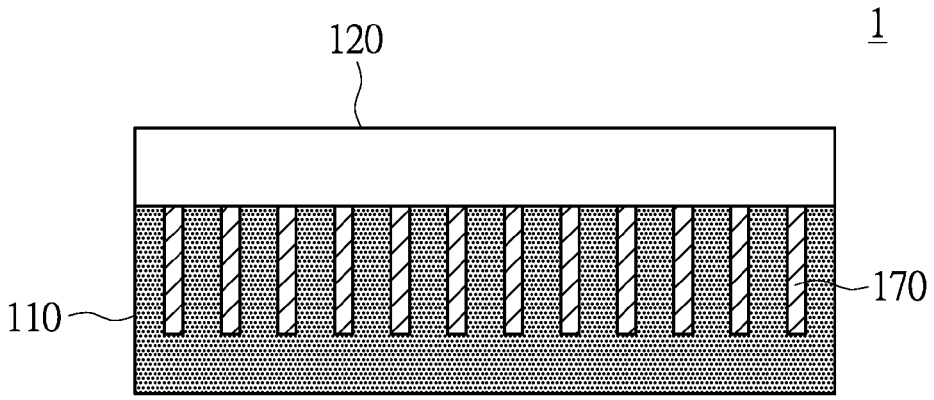
FIG. 1A is a cross-sectional view of a frequency reflector according to one embodiment of the present invention.
Figure 1B:
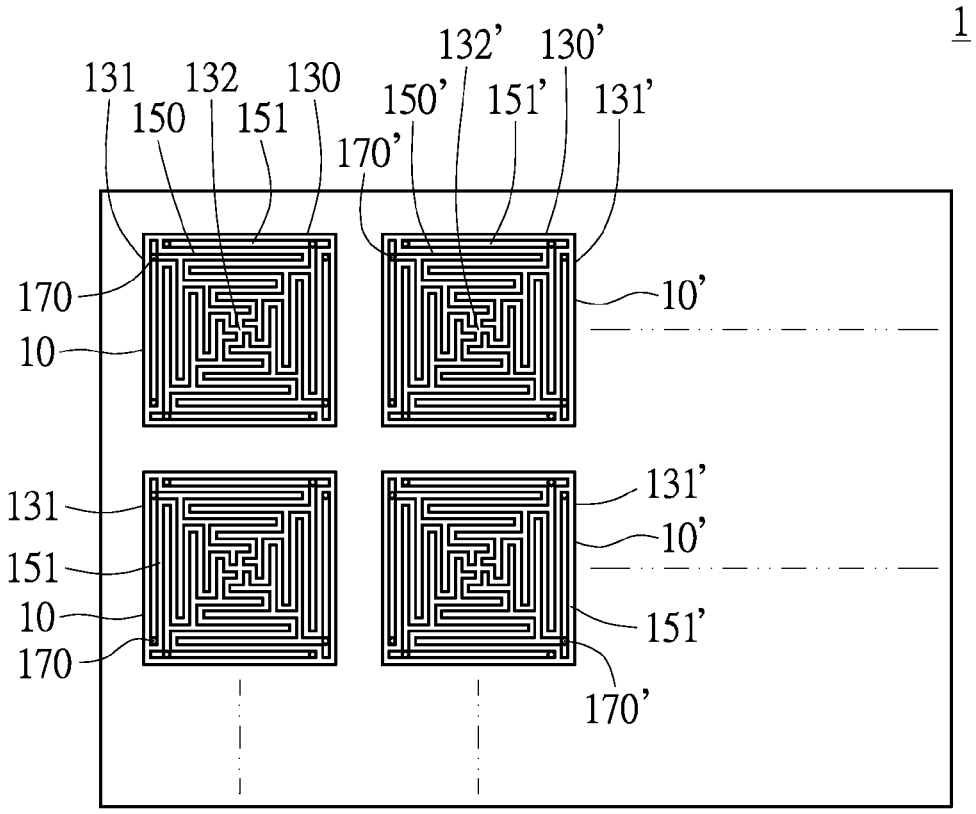
FIG. 1B is a top view of a frequency reflector according to one embodiment of the present invention.

Please refer to FIG. 1A and FIG. 1B. FIG. 1A is a cross-sectional view of a frequency reflector according to one embodiment of the present invention; and FIG. 1B is a top view of a frequency reflector according to one embodiment of the present invention. As shown in FIG. 1A and FIG. 1B, the frequency reflector 1 is suitable for using in preventing the antennas from being interfered with by the environment. The frequency reflector 1 includes a plurality of frequency reflecting units 10, 10' periodically arranged. The frequency reflector 1 includes a dielectric layer 110, a metal layout layer 120 and a plurality of vias 170 disposed in the dielectric layer 110.

The frequency reflecting unit 10 is, for example, a spatial filter unit or a wave absorbing unit. When the frequency reflecting unit 10 is a spatial filter unit, the frequency reflecting unit 10 only allows the transverse electric waves or the transverse magnetic waves within a specific frequency range to penetrate, and reflects the transverse electric waves or the transverse magnetic waves within other frequency ranges. When the frequency reflecting unit 10 is a wave absorbing unit, the frequency reflecting unit 10 absorbs the transverse electric waves or the transverse magnetic waves within a specific frequency range, and reflects the transverse electric waves or the transverse magnetic waves within other frequency ranges. One embodiment of the present invention is exemplified by, but not limited to, the frequency reflecting unit 10 implemented using a spatial filter unit.

With reference to FIG. 1A and FIG. 1B, a metal layer is formed on the dielectric layer 110 in advance. A plurality of periodically arranged metal patterns 130, 130' are formed on the metal layer by photolithography or laser cutting so as to define a metal layout layer 120. In other words, a plurality of metal patterns 130, 130' are disposed on the defined metal layout layer 120. Each of the metal patterns 130, 130' corresponds to a frequency reflecting unit 10, 10'. Each of the metal patterns 130, 130' may be formed by a plurality of metal conductors 150, 150' connected at a symmetric center 132, 132' of the metal patterns 130, 130'. On the other hand, another side of the dielectric layer 110 opposite to the metal layout layer 120 is not provided with any metal layer.

Each of metal conductors 150, 150' extends inwards from a periphery 131, 131' of the metal pattern 130, 130'. A long side 151, 151' of the metal conductor 150, 150' is disposed on the periphery 131, 131' corresponding thereto. The long side 151 of the metal conductor 150 of the metal pattern 130 is adjacent to the long side 151' of the metal conductor 150' of another metal pattern 130' adjacent to the metal pattern 130.

It should be noted that, in the present embodiment, each of the metal patterns 130, 130' is formed by the plurality of metal conductors 150, 150' connected at the symmetric center 132, 132' of the metal patterns 130, 130'. However, in other embodiments, the plurality of metal conductors 150, 150' may be isolated from each other without any connection, or may be connected elsewhere on the metal patterns 130, 130'.

Figure 2A:
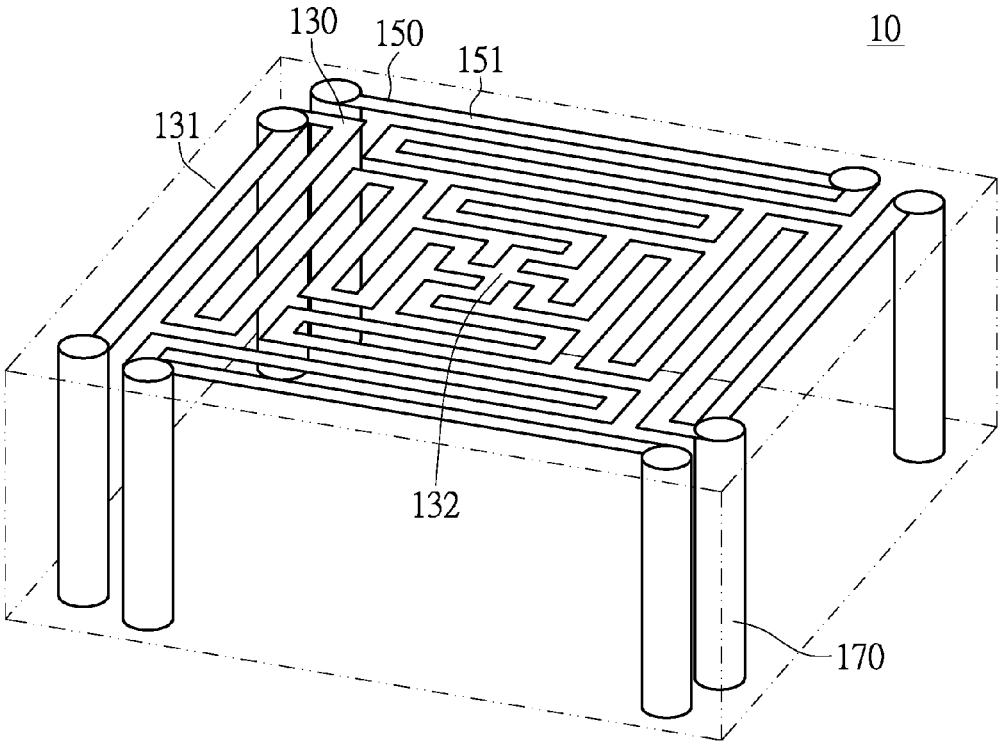
FIG. 2A is a perspective view of a frequency reflecting unit according to one embodiment of the present invention.
Figure 2B:
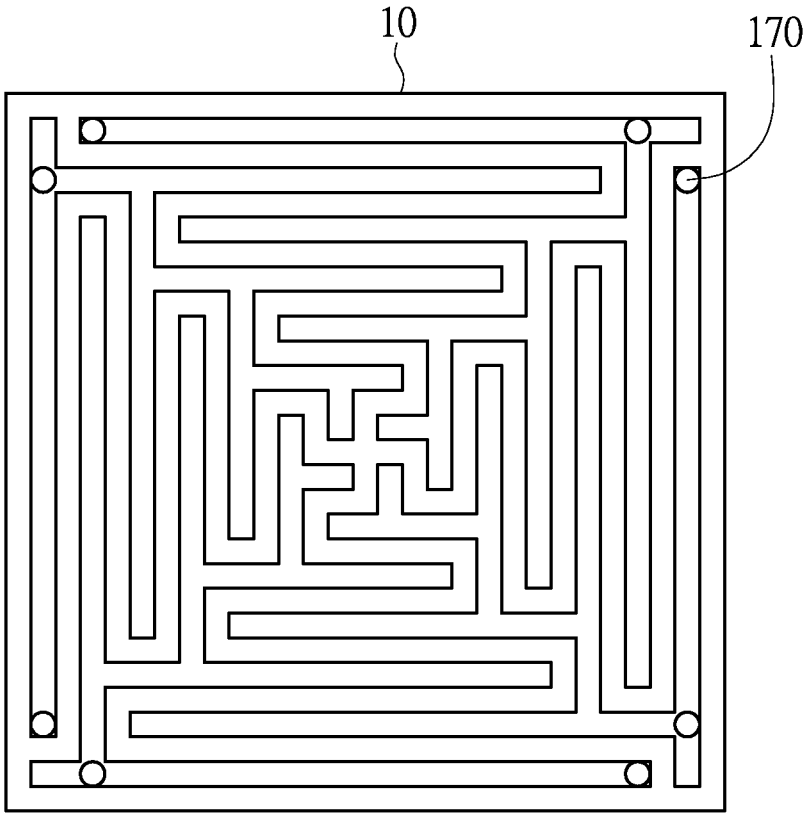
FIG. 2B is a top view of a frequency reflecting unit according to one embodiment of the present invention.
Figure 2C:
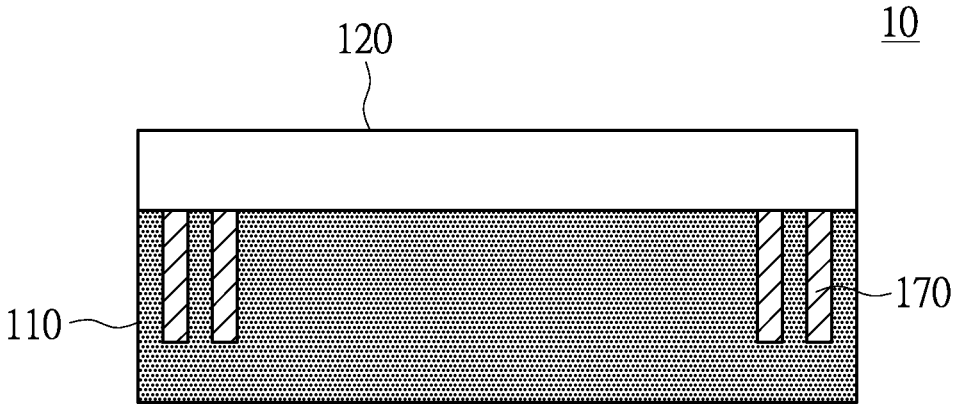
FIG. 2C is a cross-sectional view of a frequency reflecting unit according to one embodiment of the present invention.

Please refer to FIG. 1A and FIG. 1B, in view of FIG. 2A to FIG. 2C. FIG. 2A is a perspective view of a frequency reflecting unit according to one embodiment of the present invention; FIG. 2B is a top view of a frequency reflecting unit according to one embodiment of the present invention; and FIG. 2C is a cross-sectional view of a frequency reflecting unit according to one embodiment of the present invention. In addition to the metal pattern 130, the frequency reflecting unit 10 further includes at least one via 170 disposed in the dielectric layer 110. One end of the via 170 is disposed corresponding to the metal pattern 130, and the via 170 forms a non-zero angle with the metal layout layer 120.

In the present embodiment, the via 170 is further electrically connected to the long side 151 of one of the metal conductors 150 and forms a non-zero angle with the metal layout layer 120 so that the frequency reflecting unit 10 extends towards a direction other than the metal pattern 130. The other end of the via 170 corresponding to the metal pattern 130 on the metal layout layer 120 is an open circuit. For example, if the metal pattern 130 extends inwards from the periphery 131, 131' along the x-y plane, one end of the via 170 is disposed corresponding to the metal pattern 130 along the z-axis. The via 170 forms a non-zero angle with the metal layout layer 120. For example, the via 170 forms a 90-degree angle with the metal layout layer 120 so that the frequency reflecting unit 10 is cubic.

It should be noted that, the present invention is not limited to the number of vias 170. In one embodiment of the present invention, the number of vias 170 is two on each of the four sides. The vias 170 are electrically connected to both ends of the long side 151 of one of the metal conductors 150. In other embodiments, the number of vias 170 may be five or another different number on each of the four sides.

On the other hand, the present invention is not limited to how the via 170 is disposed. In one embodiment of the present invention, the via 170 is disposed corresponding to the periphery 131 of the metal pattern 13. In other embodiments, the via 170 may also be disposed elsewhere corresponding to the metal pattern 130.

It should be noted that, in one embodiment of the present invention, the via 170 is electrically connected to the long side 151 of one of the metal conductors 150. However, the present invention is not limited thereto. The via 170 may also be isolated from any metal conductor 150 on the metal pattern 130, or any metal conductor 150 on the metal pattern 130 may be electrically connected between the two ends of the via 170. In other words, the present invention is not limited to how the via 170 is connected.

However, it is preferable that, to efficiently enhance the capacitance of the capacitor between the frequency reflecting units 10, 10', the via 170 is disposed corresponding to the periphery 131 of the metal pattern 130. Simply put, the present invention is not limited to the number of vias 170 of the frequency reflecting unit 10 and how the vias 170 are disposed. Those with ordinary skill in the art may make modifications to the structure of the frequency reflecting unit 10 according to practical demands.

Furthermore, the frequency reflecting unit 10 and another frequency reflecting unit 10' adjacent to the frequency reflecting unit 10 may include different numbers of vias 170, 170'. In the present embodiment, the frequency reflecting unit 10 and the frequency reflecting unit 10' include two vias 170, 170' disposed on each of the four sides. In other embodiments, the frequency reflecting unit 10 may include two vias 170 disposed on each side, while the frequency reflecting unit 10' may include three vias 170' disposed on each side. However, the present invention is not limited to the same number of vias 170, 170' disposed in each frequency reflecting unit 10, 10'. To make it more clear, in one embodiment of the present invention, two vias 170 are disposed on each side of the frequency reflecting unit 10.

Figure 3:
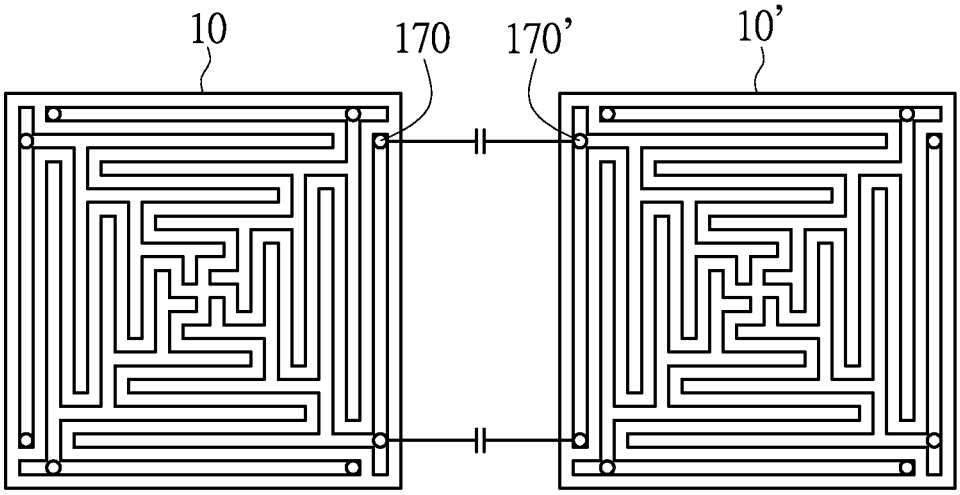
FIG. 3 is a schematic diagram showing a capacitor formed between two frequency reflecting units according to one embodiment of the present invention.

Please refer to FIG. 3. FIG. 3 is a schematic diagram showing a capacitor formed between two frequency reflecting units according to one embodiment of the present invention. Since the via 170 of the frequency reflecting unit 10 is adjacent to the via 170' of another frequency reflecting unit 10' adjacent to the frequency reflecting unit 10, an equivalent capacitor with a large capacitance is formed between the via 170 and the via 170'. Furthermore, the metal conductor 150 or 150' extends inwards from the periphery 131, 131' to form an equivalent inductor with a larger inductance. Accordingly, no additional capacitors and/or inductors are required to be attached onto the frequency reflecting unit 10 to lower the band-pass frequencies and the band-stop frequencies. Compared to the conventional frequency reflector, the area of the frequency reflecting unit 10 in one embodiment of the present invention is reduced so that the frequency reflector 1 may be further minimized.

Furthermore, a plurality of periodically arranged metal patterns 130, 130' form a large-area metal surface. Thus, the frequency reflector 1 only allows the electromagnetic waves within the band-pass frequencies on metal pattern 130, 130' to penetrate, and reflects the electromagnetic waves within the band-stop frequencies. The band-pass frequencies and the band-stop frequencies for the frequency reflector 10, 10' depend on any of the total length of the metal conductor 150, 150', the number of vias 170, 170', the total length of the vias 170, 170', and how the vias 170, 170' are disposed. Hence, the band-pass frequencies of the frequency reflector can be adjusted by designing the total length of the metal conductor 150, 150', the number of vias 170, 170', the total length of the vias 170, 170', and how the vias 170, 170' are disposed so as to prevent the electronic apparatus circuitry from being interfered with by environmental noise.

In the present embodiment, the metal patterns 130, 130' are two-dimensional metal patterns being a square with the same size and shape. Each of the metal patterns 130, 130' includes four metal conductors 150, 150'. The metal conductor 150, 150' extend inwards from the periphery 131, 131' to the symmetric center 132, 132' on the metal pattern 130, 130'. However, the present invention is not limited thereto. The metal pattern 130, 130' may be a polygon or a curve. The shape or the size of the metal pattern 130, 130' may be different. The metal patterns 130, 130' may also be three-dimensional metal patterns. However, it is preferable that the metal pattern 130, 130' is a symmetric curve or a symmetric polygon. The metal conductor 150, 150' extends inwards from the periphery 131, 131' to the symmetric center 132, 132' on the metal pattern 130, 130' to reduce the influence of the incident angle on the frequency reflector.

It should be noted that the present invention is not limited to the number of metal patterns 130, 130' that form the metal layout layer 120 of the frequency reflector 1. Those with ordinary skill in the art may modify the number of metal patterns 130, 130' according to practical demands. On the other hand, the present invention is not limited to the materials of the dielectric layer 110. Those with ordinary skills in the art may modify the materials of the dielectric layer 110 to work with the metal layout layer 120 according to practical demands.

In the embodiment shown in FIG. 1A and FIG. 1B, the dielectric layer 110 is a single-layered dielectric layer, and the metal patterns 130, 130' of the frequency reflecting units 10, 10' are disposed on the top surface of the dielectric layer 110. However, the present invention is not limited thereto. For example, the metal patterns 130, 130' are disposed on a bottom surface of the dielectric layer 110 (meanwhile, the bottom surface of the dielectric layer 110 is provided with another metal layout layer not shown in FIG. 1A and 1B). Alternatively, the metal patterns 130, 130' are disposed alternately on the bottom surface and the top surface of the dielectric layer 110 (meanwhile, both of the bottom surface and the top surface of the dielectric layer 110 are provided with metal layout layers). The vias 170, 170' are disposed corresponding to the metal patterns 130, 130'. In addition, the dielectric layer 110 may be a multi-layered dielectric layer. The metal patterns 130, 130' are disposed on the same or different top surface and/or the bottom surface.

In the present embodiment, the metal conductors 150, 150' are serpentine metal conductors that extend inwards to a symmetric center 132, 132' and are connected at the symmetric center 132, 132'. However, the present invention is not limited to the shape of the metal conductors 150, 150'. In other embodiments, in addition to extending from the periphery 131, 131' towards the symmetric center 132, 132', some dendritic portions of the metal conductors 150, 150' do not extend to the symmetric center 132, 132'. Generally speaking, the metal conductors 150, 150' extend from the periphery 131, 131' to the symmetric center 132, 132'.

Figure 4A:
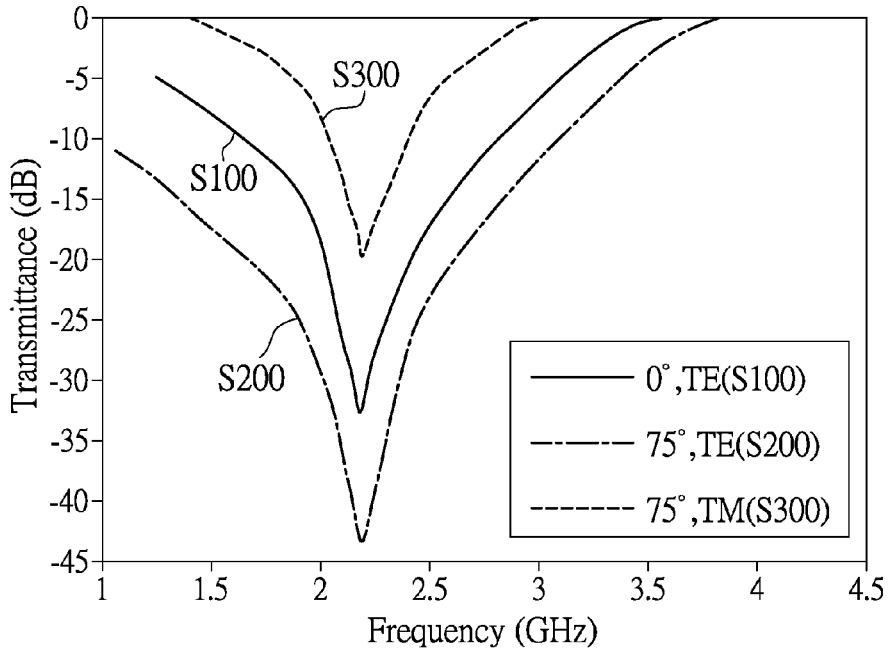
FIG. 4A is a graph showing transmittance curves for the transverse electric wave and the transverse magnetic wave with different angles received by the frequency reflector as shown in FIG. 1A and FIG. 1B.
Figure 4B:
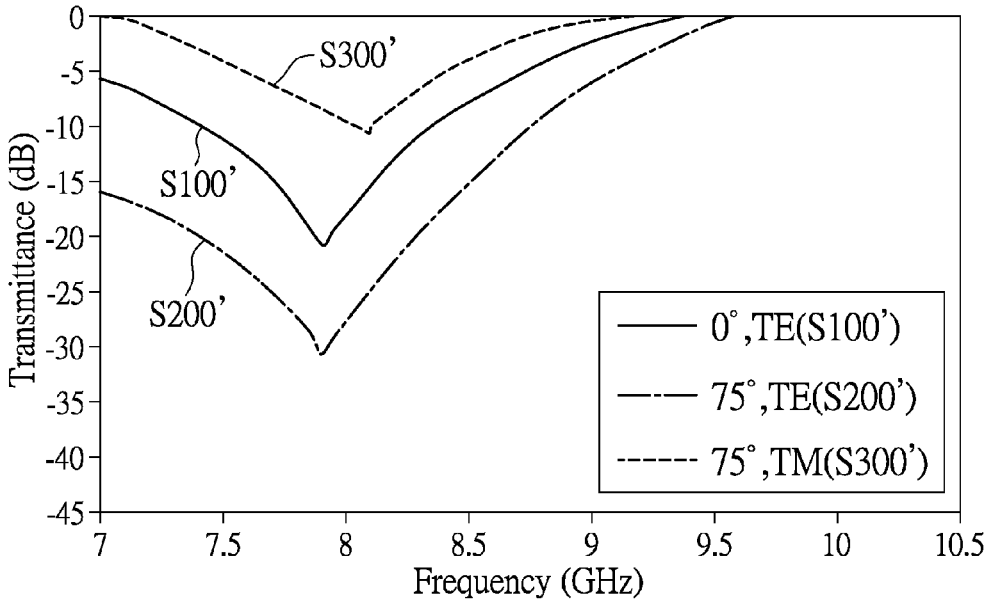
FIG.4B(PRIOR ART)
FIG. 4B is a graph showing transmittance curves for the transverse electric wave and the transverse magnetic wave with different angles received by a conventional frequency reflector.

Please refer to FIG. 4A and FIG. 4B. FIG. 4A is a graph showing transmittance curves for the transverse electric wave and the transverse magnetic wave with different angles received by the frequency reflector as shown in FIG. 1A and FIG. 1B; and FIG. 4B is a graph showing transmittance curves for the transverse electric wave and the transverse magnetic wave with different angles received by a conventional frequency reflector. It should be noted that the frequency reflector 1 is only different from the conventional frequency reflector in that the frequency reflecting unit 10 of the frequency reflector 1 further includes at least one via 170, while the conventional frequency reflector does not include any via 170.

In FIG. 4A, the longitudinal axis denotes the transmittance in dB, and the transverse axis denotes the frequency in giga-Hertz (GHz). The curves S100 and S200 represent the transmittance as a function of frequency of the frequency reflector 1 with respect to the transverse electric waves with an incident angle of 0 and 75 degrees. The curve S300 represents the transmittance as a function of frequency of the frequency reflector 1 with respect to the transverse magnetic waves with an incident angle of 75 degrees. In FIG. 4B, the longitudinal axis and the transverse axis are similar to those in FIG. 4A, and thus descriptions thereof are not redundantly repeated herein. In FIG. 4B, the curves S100' and S200' represent the transmittance as a function of frequency of the conventional frequency reflector with respect to the transverse electric waves with an incident angle of 75 degrees. The curve S300' represents the transmittance as a function of frequency of the conventional frequency reflector with respect to the transverse magnetic waves with an incident angle of 75 degrees.

In view of FIG. 4A and FIG. 4B, under the circumstance that the frequency reflector 1 and the conventional frequency reflector include the same number of frequency reflecting units 10 and the metal patterns 130 have the same shape, the band-stop frequencies for the conventional frequency reflector centers at 7.96 GHz, while the band-stop frequencies for the frequency reflector 1 drops to about 2.36 GHz. In other words, if the user desires to filter out the noise centering at 2.36 GHz, the frequency reflector 1 in one embodiment of the present invention may achieve the same performance with a reduced area.

As stated above, one embodiment of the present invention employs a via 170 to effectively enhance the equivalent capacitor and the equivalent inductor of the frequency reflecting unit 10 to further adjust the band-pass frequencies and band-stop frequencies of the frequency reflector 1. Compared to the currently available frequency reflectors, the frequency reflector 1 in one embodiment of the present invention can further be minimized.

(Embodiment of Electronic Apparatus)

Figure 5:
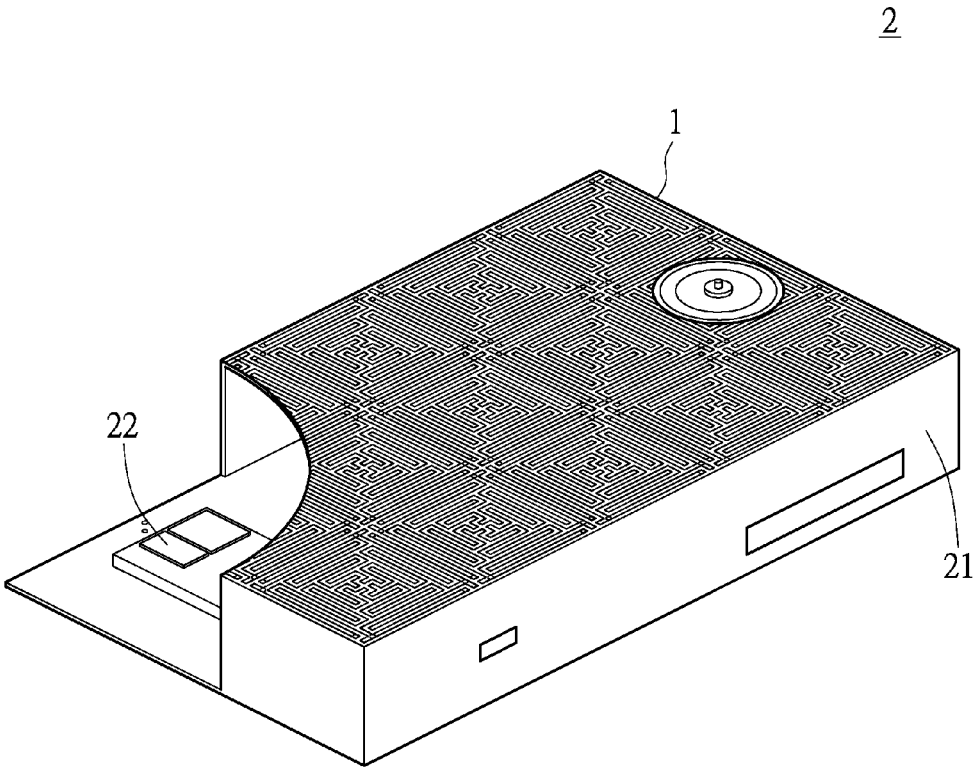
FIG. 5 is a schematic diagram of a frequency reflector attached onto the housing of an electronic apparatus according to another embodiment of the present invention.

Please refer to FIG. 5, which is a schematic diagram of a frequency reflector attached onto the housing of an electronic apparatus according to another embodiment of the present invention. The frequency reflector 1 can be applicable to the electronic apparatus 2, to which the present invention is not limited. The electronic apparatus 2 typically includes a housing 21 and an electronic apparatus circuitry 22. The housing 21 covers the electronic apparatus circuitry 22. By disposing or attaching the frequency reflector 1 onto the housing 21, the electronic apparatus 2 may be prevented from being interfered with by the environment. Furthermore, the electronic apparatus 2 may be, for example, a cell phone, a personal tablet PC, a notebook computer or an electronic radar.

Taking the communication frequencies used in the third generation mobile communication for example, the band-pass frequencies for the frequency reflector 1 may be designed to center at 900 MHz, 1800 MHz or 2000 MHz. Accordingly, if the frequency reflector 1 is disposed on the housing of a cell phone, the antenna in the cell phone is not influenced by the frequency reflector 1 and is able to receive and transmit signals. However, the electromagnetic waves away from the band-pass frequencies are reflected by the frequency reflector 1. Thus, the frequency reflector 1 may protect the cell phone from being interfered with by the environmental noise. Furthermore, the directivity and the gain along a specific direction of the antenna in the electronic apparatus 2 may be improved by the characteristics of the frequency reflector 1.

(Other Embodiments of Frequency Reflecting Unit)

Figure 6A:
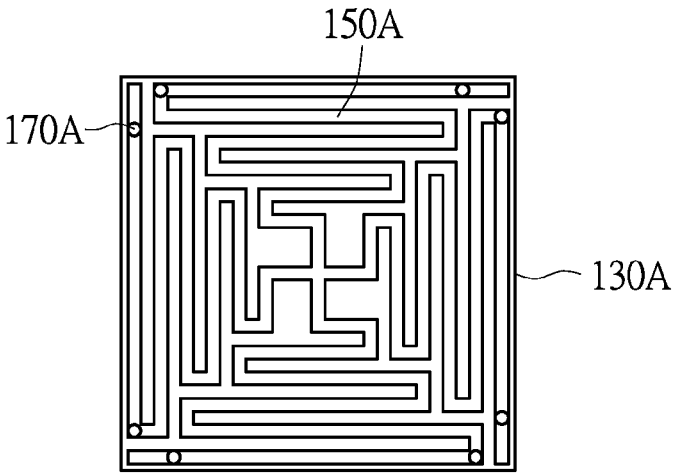
FIG. 6A to FIG. 6C are top views of frequency reflecting units according to other embodiments of the present invention.

With reference to FIG. 6A, FIG. 6A is a top view of a frequency reflecting unit according to another embodiment of the present invention. Compared to the metal conductor 150, 150' on the metal pattern 130, 130' in FIG. 1B, the metal conductor 150A on the metal pattern 130A in FIG. 6A is also a serpentine metal conductor, but the metal conductor 150A does not include a dendritic portion that does not extend towards the symmetric center 132, 132'. The metal pattern 130A in FIG. 6A may replace the metal pattern 130, 130' in FIG. 1B to form another type of frequency reflector.

Figure 6B:
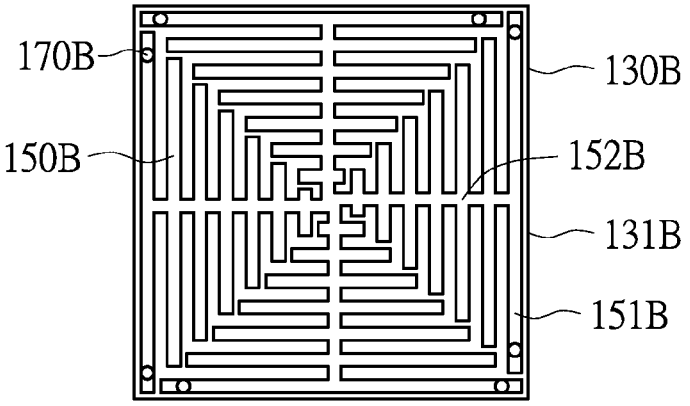

With reference to FIG. 6B, FIG. 6B is a top view of a frequency reflecting unit according to another embodiment of the present invention. Compared to the metal conductor 150, 150' on the metal pattern 130, 130' in FIG. 1B, the metal conductor 150B on the metal pattern 130B in FIG. 6B is a dendritic metal conductor with a long side 151B disposed on the periphery 131B. The long side 151B is a branch portion of the main trunk portion of the metal conductor 150B. In FIG. 6B, the metal conductor 150B includes other branch portions with length smaller than the long side 151B. The metal pattern 130B in FIG. 6B may replace the metal pattern 130, 130' in FIG. 1B to form another type of frequency reflector.

Figure 6C:
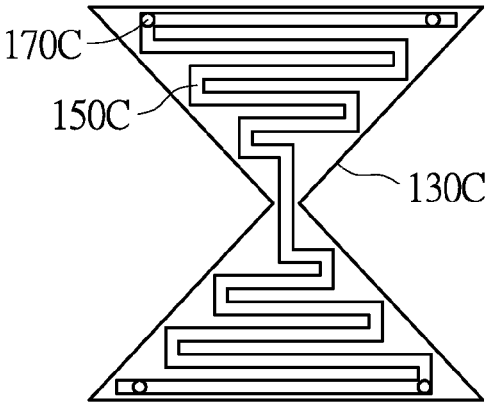
Figure 7A:
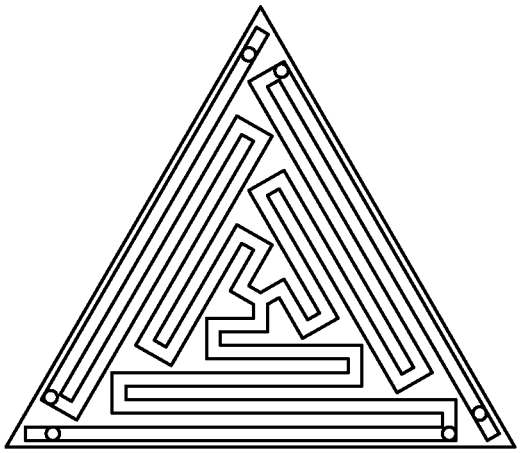
FIG. 7A to FIG. 7D are top views of frequency reflecting units according to other embodiments of the present invention.
Figure 7B:
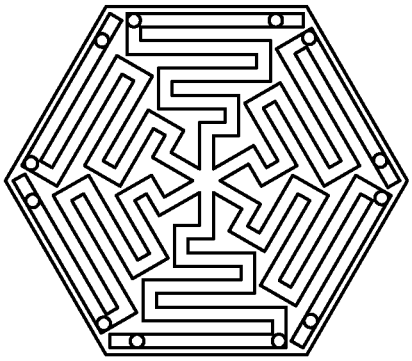
Figure 7C:
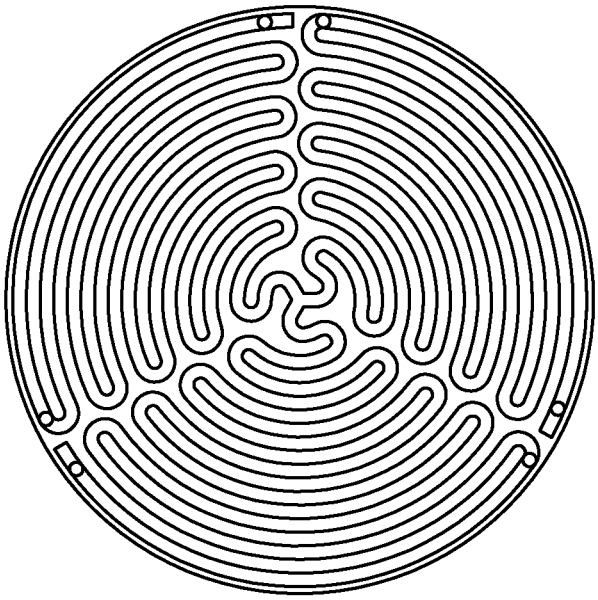
Figure 7D:
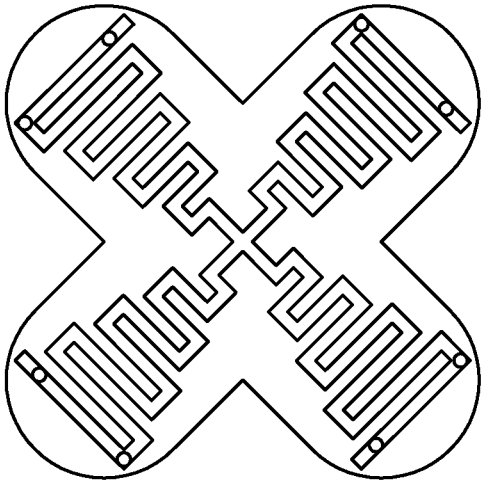

With reference to FIG. 6C, FIG. 6C is a top view of a frequency reflecting unit according to another embodiment of the present invention. The metal conductor 150C on the metal pattern 130C in FIG. 6C is similar to the metal conductor 150, 150' on the metal pattern 130, 130' in FIG. 1B. However, the metal pattern 130C in FIG. 6C only has two metal conductors 150C. In other words, the metal pattern 130C in FIG. 6C is not a square, but a symmetric dual taper including two triangles. The metal pattern 130C in FIG. 6C may replace the metal pattern 130, 130' in FIG. 1B to form another type of frequency reflector.

Please refer to FIG. 7A to FIG. 7D. FIG. 7A to FIG. 7D are top views of frequency reflecting units according to other embodiments of the present invention. In FIG. 7A to FIG. 7D, the metal patterns of the frequency reflecting units are respectively a triangle, a hexagon, a circle and a symmetric curve. The metal pattern in FIG. 7A includes three serpentine metal conductors. The metal pattern in FIG. 7B includes six serpentine metal conductors. The metal pattern in FIG. 7C includes three serpentine metal conductors. The metal pattern in FIG. 7D includes four serpentine metal conductors. The metal patterns in FIG. 7A to FIG. 7D may replace the metal pattern 130, 130' in FIG. 1B to form another type of frequency reflector.

Figure 8A:
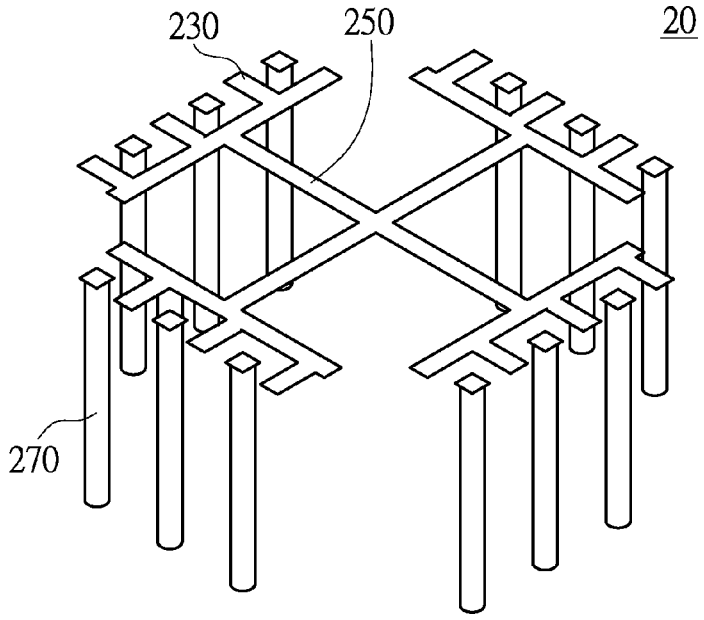
FIG. 8A to FIG. 8B are perspective views of frequency reflecting units according to another embodiment of the present invention.

Please refer to FIG. 8A. FIG. 8A is a perspective view of a frequency reflecting unit according to another embodiment of the present invention. The frequency reflecting unit 20 in FIG. 8A is different from the frequency reflecting unit 10 in FIG. 2 in that the metal pattern 230 of the frequency reflecting unit 20 in FIG. 8A includes four fork-shaped metal conductors 250. The periphery of each of the fork-shaped metal conductors 250 includes three vias 270. The vias 270 are not electrically connected to one another. It should be noted that the vias 270 are not electrically connected to the fork-shaped metal conductor 250. The frequency reflecting unit 20 in FIG. 8A may replace the frequency reflecting unit 10 in FIG. 2 to form other types of frequency reflectors.

Figure 8B:
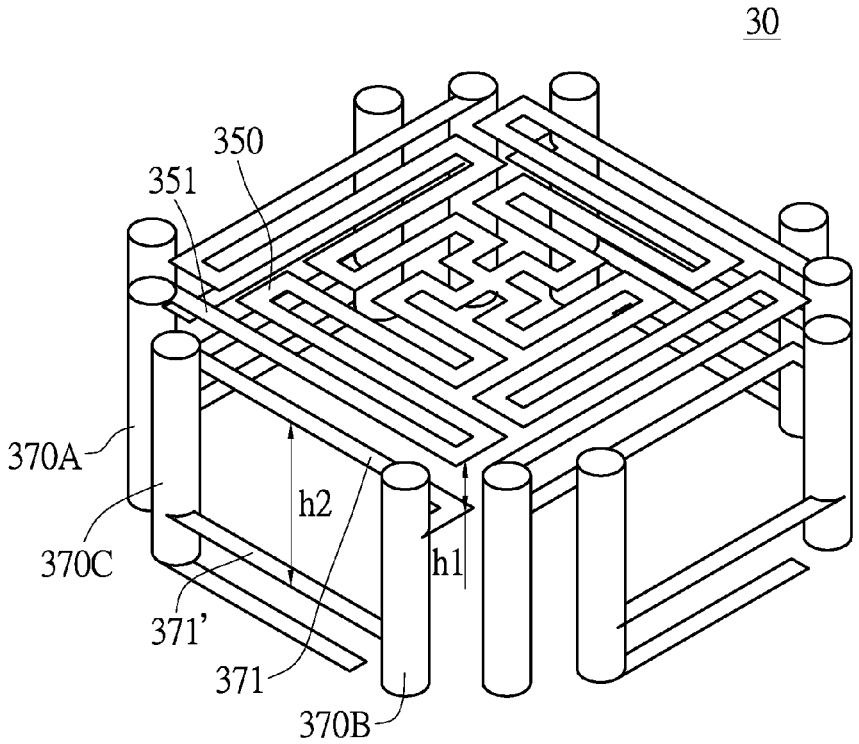

With reference to FIG. 8B, FIG. 8B is a perspective view of a frequency reflecting unit according to another embodiment of the present invention. The frequency reflecting unit 30 in FIG. 8B is different from the frequency reflecting unit 10 in FIG. 2 in that the long side 351 of each of the metal conductors 350 of the frequency reflecting unit 30 in FIG. 8B is only electrically connected to a via 370A. The via 370A is electrically connected to another via 370B through a conductor element 371 that is h1 cm below the long side 351 of the metal conductor 350, and h1 is greater than zero. Then, the via 370B is further electrically connected to the via 370C through another conductor element 371' that is h2 cm below the conductor element 371, and h2 is greater than zero. Accordingly, the capacitance of the equivalent capacitor formed between the frequency reflecting unit 30 and another frequency reflecting unit 30' adjacent to the frequency reflecting unit 30 may be further enhanced.

It should be noted that the conductor elements 371, 371' may be designed to be serpentine or straight. Those with ordinary skill in the art may make modification on the length or the width of the conductor elements 371, 371' so that the impedance of the frequency reflecting unit 30 increases. The conductor elements 371, 371' connecting different vias 370A, 370B and 370C may include any conductive material. The present invention is not limited to the conductive material to electrically connect different vias. The present invention is not limited to the number of the conductor elements 371, 371'. In the present embodiment, the via 370A is electrically connected to the via 370B through the conductor element 371, the via 370B is electrically connected to the via 370C through the conductor element 371'. In other embodiments, the via 370C may also be electrically connected to other vias through a conductor element (not shown in FIG. 8B). Furthermore, the present invention is not limited to h1 and h2. Those with ordinary skill in the art may modify h1 and h2 according to practical demands. As stated above, those with ordinary skill in the art can modify the structure of the frequency reflecting unit 30 to adjust the band-pass frequencies and the band-stop frequencies for the frequency reflector.

Figure 9:
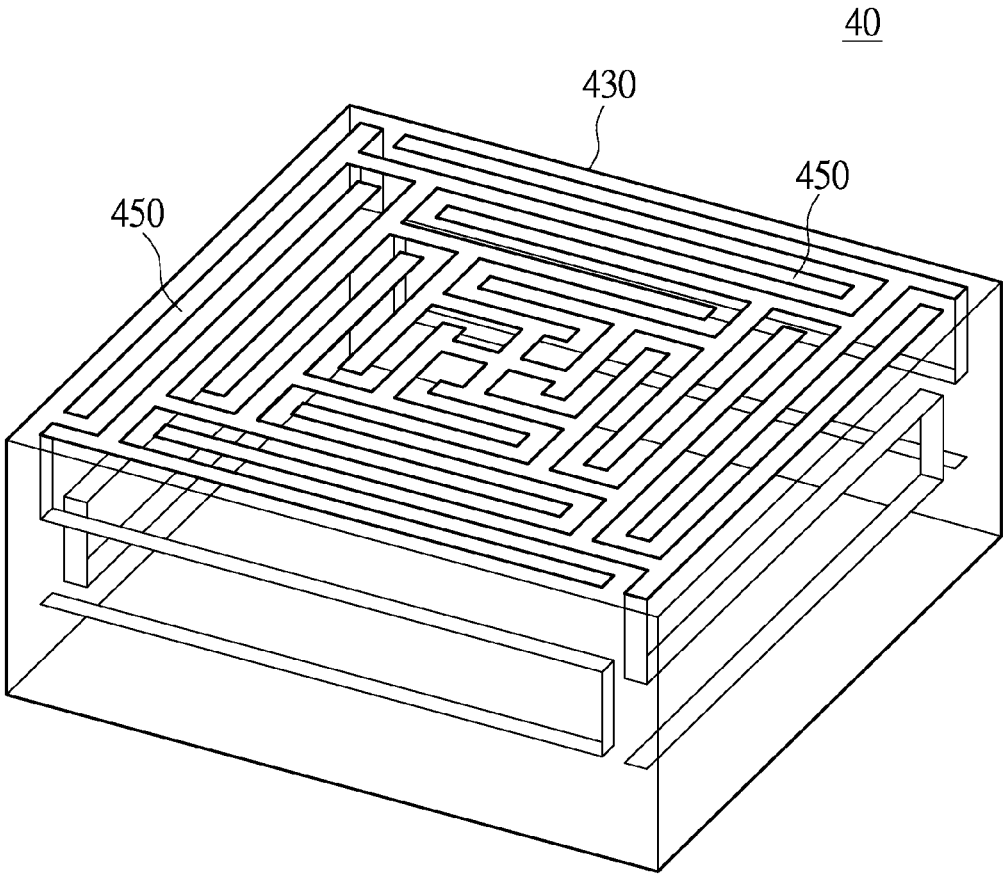
FIG. 9 is a perspective view of a frequency reflecting unit according to another embodiment of the present invention.

Please refer to FIG. 9. FIG. 9 is a perspective view of a frequency reflecting unit according to another embodiment of the present invention. Unlike the previous embodiments, the frequency reflecting unit 40 in FIG. 9 does not employ a plurality of vias to increase the capacitance of the equivalent capacitor and the inductance of the equivalent inductor of the frequency reflecting unit 40. Instead, the metal pattern 430 of the frequency reflecting unit 40 is a three-dimensional metal pattern. Certainly, at least one via can be disposed in the frequency reflecting unit 40.

In one embodiment of the present invention, the metal pattern 430 is a square including four metal conductors 450. In addition to extending from the periphery towards the symmetric center on the metal pattern 430, the metal conductor 450 further extends downwards. The metal conductor 450 forms a non-zero angle with the metal layout layer so that the metal pattern 430 is a three-dimensional metal pattern. The portion of the metal conductor 450 extending downwards is an open circuit. An equivalent capacitor with a larger capacitance may be formed between the frequency reflecting unit 40 and another frequency reflecting unit (not shown) through the portion of the metal conductor 450 extending downwards. Simply put, the portion of the metal conductor 450 extending downwards may replace the plurality of vias in the previous embodiment to increase the capacitance of the equivalent capacitor of the frequency reflecting unit 40.

Figure 10A:
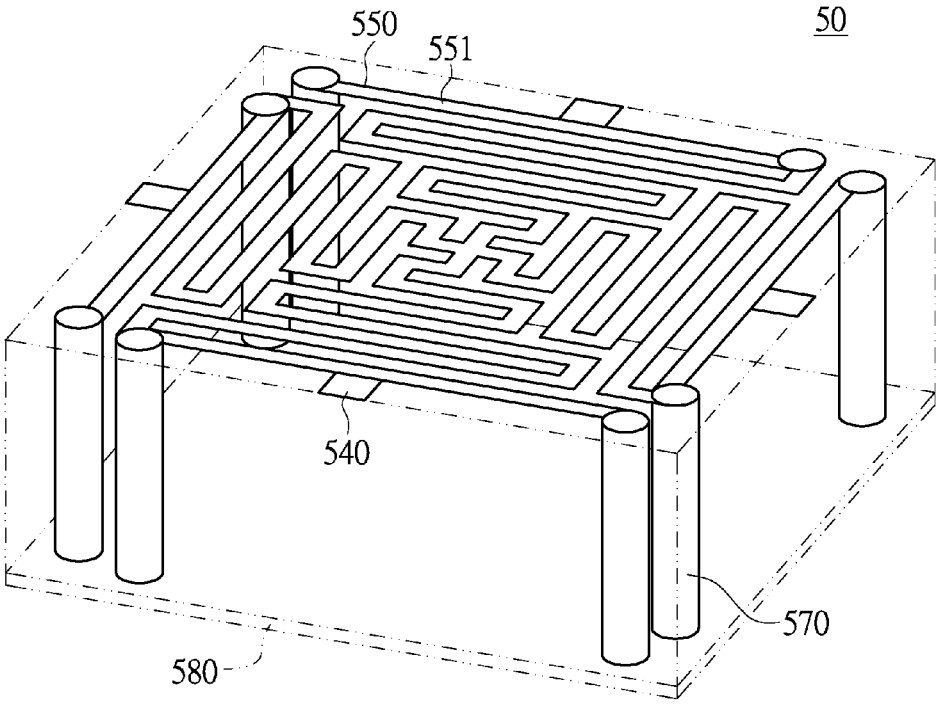
FIG. 10A is a perspective view of a frequency reflecting unit according to another embodiment of the present invention.
Figure 10B:
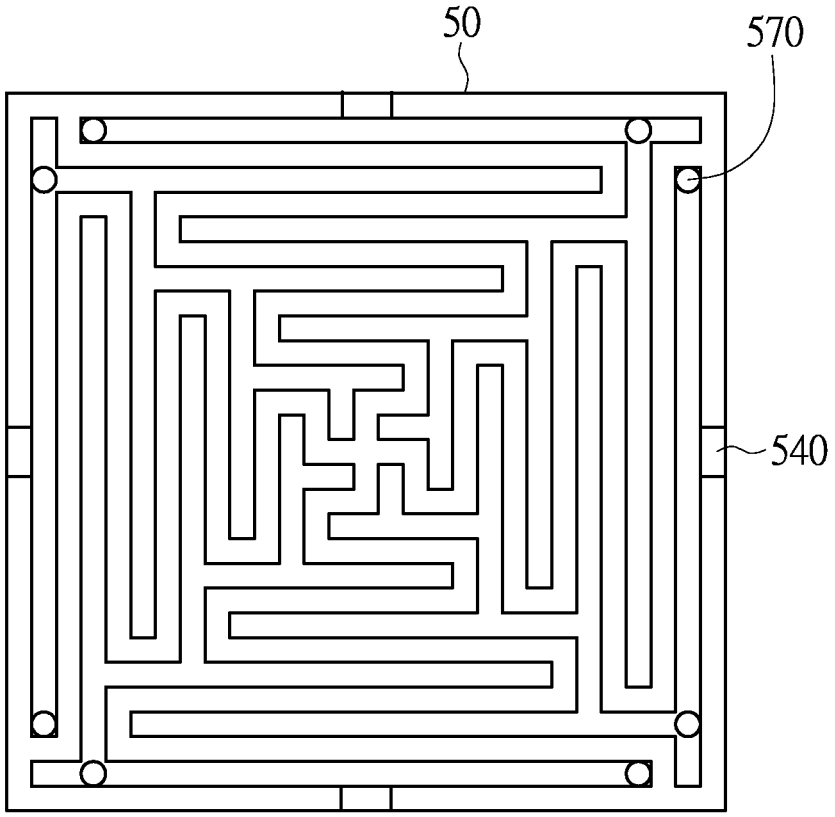
FIG. 10B is a top view of a frequency reflecting unit according to another embodiment of the present invention.
Figure 10C:
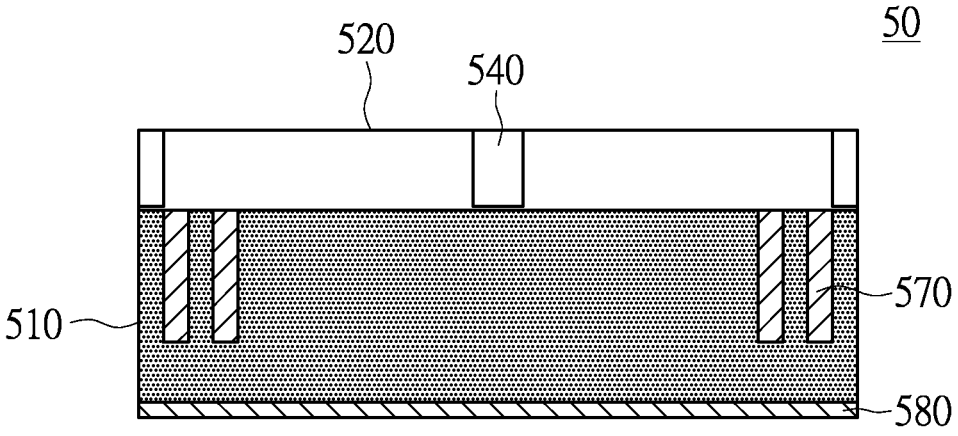
FIG. 10C is a cross-sectional view of a frequency reflecting unit according to another embodiment of the present invention.

Please refer to FIG. 10A to FIG. 10C. FIG. 10A is a perspective view of a frequency reflecting unit according to another embodiment of the present invention; FIG. 10B is a top view of a frequency reflecting unit according to another embodiment of the present invention; and FIG. 10C is a cross-sectional view of a frequency reflecting unit according to another embodiment of the present invention. Similarly, the frequency reflecting unit 50 includes a dielectric layer 510, a metal layout layer 520 and at least one via 570. Unlike FIG. 2A to FIG. 2C, the frequency reflecting unit 50 of the present embodiment is a wave absorbing unit. The frequency reflecting unit 50 further includes at least one resistor 540 to cause loss in the transverse electric wave or the transverse magnetic wave. The resistor 540 is disposed on the long side 551 of the metal conductor 550. In the present embodiment, a resistor 540 is disposed on the long side 551 of each of the metal conductors 550, to which the present invention is not limited. Furthermore, a metal back plate 580 is disposed on the other side of the frequency reflecting unit 50 corresponding to metal layout layer 520. The metal back plate 580 is not disposed any metal pattern thereon. In one embodiment of the present invention, both ends of the via 570 correspond to the metal layout layer 520 and the metal back plate 580. One end of the via 570 corresponding to the metal back plate 580 is an open circuit. However, the present invention is not limited thereto. In other embodiments, the via 570 is electrically connected to the metal layout layer 520 and the metal back plate 580 respectively, is only electrically connected to the metal back plate 580, or is only electrically connected to the metal layout layer 520.

With a metal conductor 550 and a resistor 540 disposed on the metal layout layer 520 and a metal back plate 580 corresponding to the metal layout layer 520, the frequency reflecting unit 50 can absorb the transverse electric wave or the transverse magnetic wave within a specific frequency range and reflect the transverse electric wave or the transverse magnetic wave away from the specific frequency range.

It should be noted that, in other embodiments, the metal layout layer 520 may not provide a resistor 540 disposed thereon. Instead, the metal conductor 550 and the via 570 may include low conductivity materials such as graphite, karbogel and elargol. Accordingly, the metal conductor 550 and the via 570 may cause loss in the transverse electric wave or the transverse magnetic wave.

Figure 11:
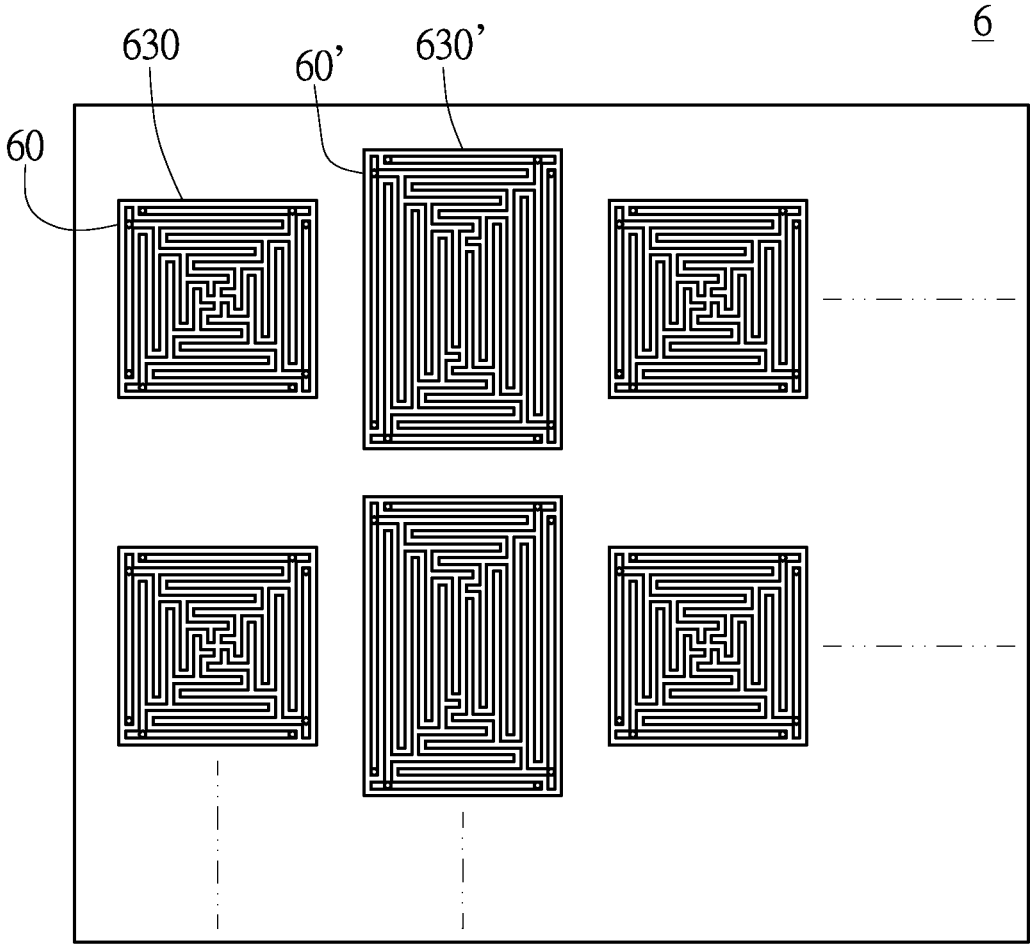
FIG. 11 is a top view of a frequency reflector according to another embodiment of the present invention.

Please refer to FIG. 11. FIG. 11 is a top view of a frequency reflector according to another embodiment of the present invention. Compared to the frequency reflector 1 in FIG. 1B, the frequency reflector 6 in FIG. 11 includes a plurality of frequency reflecting units 60, 60' with different sizes and shapes. The metal patterns 630, 630' of the frequency reflecting units 60, 60' are a square and a rectangle. The metal patterns 630, 630' include four metal conductors, and the metal conductors may be serpentine metal conductors.

Figure 12:
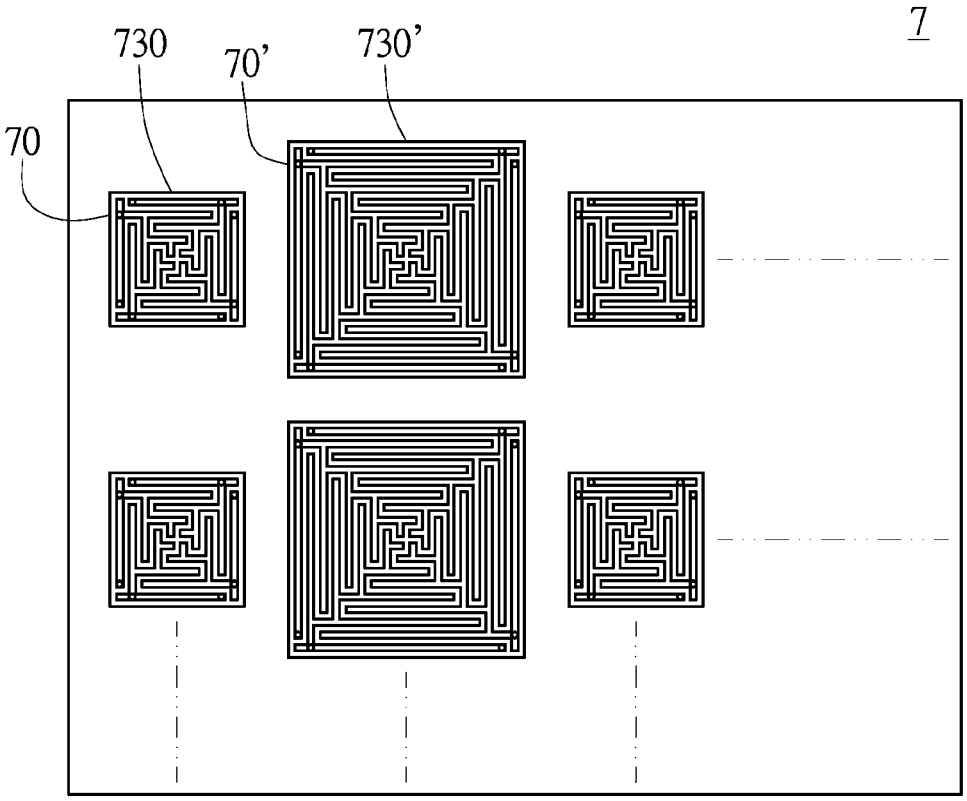
FIG. 12 is a top view of a frequency reflector according to another embodiment of the present invention.

Please refer to FIG. 12. FIG. 12 is a top view of a frequency reflector according to another embodiment of the present invention. Compared to the frequency reflector 1 in FIG. 1B, the frequency reflector 7 in FIG. 12 includes a plurality of frequency reflecting units 70, 70' with different sizes and the same shape being a square. The metal patterns 730, 730' of the frequency reflecting units 70, 70' include four metal conductors, and the metal conductors may be serpentine metal conductors.

Figure 13:
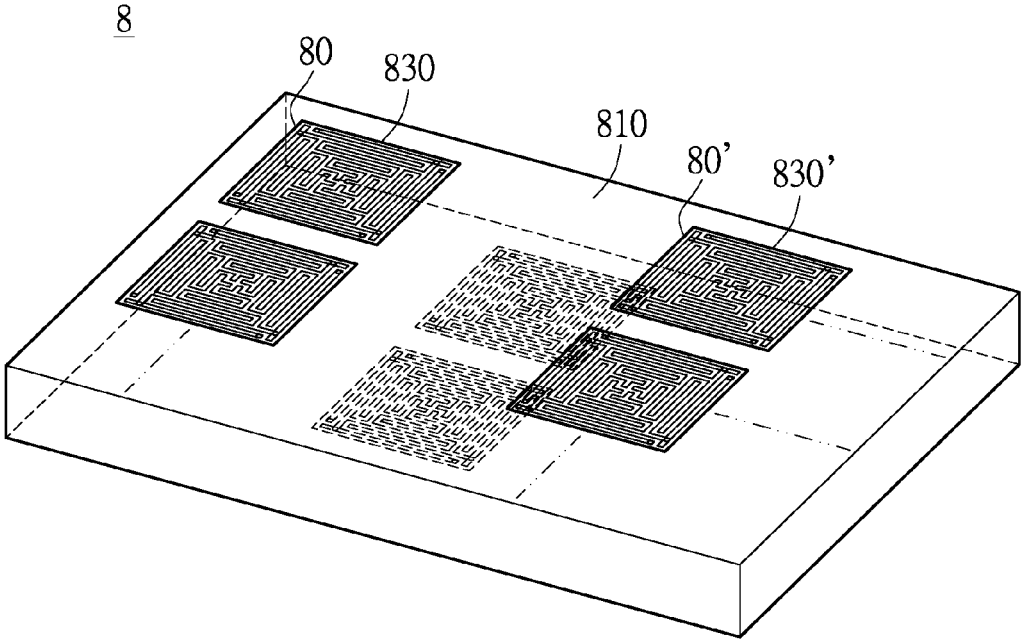
FIG. 13 is a perspective view of a frequency reflector according to another embodiment of the present invention.

Then, with reference to FIG. 13, FIG. 13 is a perspective view of a frequency reflector according to another embodiment of the present invention. Compared to the frequency reflector 1 in FIG. 1B, the frequency reflector 8 in FIG. 13 includes a plurality of frequency reflecting units 80, 80' disposed respectively on the top surface and the bottom surface of the dielectric layer 810. The metal patterns 830, 830' of the frequency reflecting units 80, 80' include four metal conductors, and the metal conductors may be serpentine metal conductors.

(Function of the Embodiment)

As stated above, one embodiment of the present invention provides a frequency reflecting unit. In the frequency reflecting unit, the via forms a non-zero angle with the corresponding metal layout layer so that the frequency reflecting unit has a three-dimensional structure. A plurality of frequency reflecting units are periodically arranged to form a frequency reflector. Since an equivalent capacitor and an equivalent inductor are induced between the vias of neighboring frequency reflecting units, no additional capacitors and inductors are required on the two-dimensional surface of the frequency reflector to lower the band-pass frequencies and the band-stop frequencies for the frequency reflector. Compared to the currently available frequency reflectors, the frequency reflector in one embodiment of the present invention exhibits lowered the communication frequencies for the frequency reflector without needing a large area.

Furthermore, in the frequency reflecting unit with a three-dimensional metal pattern, a portion of at least one metal conductor of the three-dimensional metal pattern extends outwards to the metal layout layer and the metal conductor forms a non-zero angle with the metal layout layer. Similarly, an equivalent capacitor and an equivalent inductor are induced between the three-dimensional metal patterns of neighboring frequency reflecting units, and no additional capacitors and inductors are required on the two-dimensional surface of the frequency reflector to lower the band-pass frequencies and the band-stop frequencies for the frequency reflector.

Furthermore, the directivity and the gain along a specific direction of the antenna in the electronic apparatus may be improved by the characteristics of the frequency reflector.

Furthermore, in one embodiment of the present invention, the frequency reflector blocks the electromagnetic waves within the band-stop frequencies and allows the electromagnetic waves within the band-pass frequencies to penetrate. Thereby, the directivity and the gain along a specific direction of the antenna may be improved by the characteristics of the frequency reflector. The metal pattern of the frequency reflector exhibits different reflection and transmission characteristics with respect to different angles and different frequencies of incident electromagnetic waves. When electromagnetic waves with different incident angles are within the band-pass frequencies for the metal pattern, total transmission occurs for the selected frequency range. On the contrary, when electromagnetic waves with different incident angles are within the band-stop frequencies for the metal pattern, the incident electromagnetic waves are totally reflected. Hence, the band-pass frequencies of the frequency reflector can be adjusted by designing the metal pattern of the frequency reflector so as to prevent the electronic apparatus circuitry from being interfered with by environmental noise. Furthermore, in one embodiment of the present invention, the metal pattern can be designed on the same plane or on different planes. Thus, the frequency reflector of the present invention can be used in portable products.

As stated above, the frequency reflector of present invention is applicable to various portable electronic products to provide selective frequency shielding. The frequency reflector of the present invention also prevents the user from being irradiated by the hazardous electromagnetic waves. Hence, the frequency reflector of present invention is very useful.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A frequency reflecting unit with a three-dimensional structure used as a portion of a frequency reflector, the frequency reflecting unit comprising:

a metal pattern disposed on a metal layout layer defined on one side of said frequency reflecting unit; and at least one via;

wherein one end of the via being disposed corresponding to the metal pattern, the via forms a non-zero angle with the metal layout layer, and the other end of the via is an open circuit;

wherein the metal pattern comprises a plurality of metal conductors, each of the metal conductors extending inwards from a periphery of the metal pattern, a long side of the metal conductor being disposed on the periphery corresponding thereto;

wherein the via is electrically connected to the long side of one of the plurality of metal conductors.

2. The frequency reflecting unit of claim 1, wherein the plurality of metal conductors are not connected to one another.

3. The frequency reflecting unit of claim 1, wherein the plurality of metal conductors are connected to one another at a center of the metal pattern.

4. The frequency reflecting unit of claim 1, further comprising:

a dielectric layer carrying the metal pattern and the via.

5. The frequency reflecting unit of claim 1, wherein the via and the plurality of metal conductors are not electrically connected to each other.

6. The frequency reflecting unit of claim 1, wherein the via is electrically connected to the long side of one of the plurality of metal conductors, and the via is electrically connected to another via through a conductor element that is h cm below the long side, wherein h is greater than zero.

7. The frequency reflecting unit of claim 1, wherein the metal pattern is a curve or polygon.

8. The frequency reflecting unit of claim 5, wherein the curve is a symmetric curve and the polygon is a symmetric polygon.

9. The frequency reflecting unit of claim 1, wherein the metal conductor extends towards a symmetric center of the metal pattern from the periphery corresponding thereto.

10. The frequency reflecting unit of claim 1, wherein the metal conductor is a dendritic metal conductor, a serpentine metal conductor or a fork-shaped metal conductor.

11. The frequency reflecting unit of claim 1, wherein said frequency reflecting unit is a spatial filter unit.

12. The frequency reflecting unit of claim 1, wherein the frequency reflector comprises N of the frequency reflecting units periodically arranged, wherein N is an integer larger than one.

13. The frequency reflecting unit of claim 10, wherein when each of the plurality of frequency reflecting units is the frequency reflecting unit of claim 1, the long side of the metal conductor of the metal pattern of the frequency reflecting unit is adjacent to the long side of the metal conductor of the metal pattern of another frequency reflecting unit.

14. A frequency reflecting unit with a three-dimensional structure, used as a portion of a frequency reflector, the frequency reflecting unit comprising:

a metal pattern disposed on a metal layout layer defined on one side of the frequency reflecting unit;

a metal back plate, disposed on the other side of the frequency reflecting unit opposite to said metal layout layer; and at least one via;

wherein one end of said via is disposed corresponding to the metal pattern, the via forms a non-zero angle with the metal layout layer, and the other end of the via corresponding to the metal pattern is an open circuit;

wherein the metal pattern comprises a plurality of metal conductors, each of the metal conductors extending inwards from a periphery of the metal pattern, a long side of the metal conductor being disposed on the periphery corresponding thereto;

wherein the via is electrically connected to the long side of one of the plurality of metal conductors.

15. The frequency reflecting unit of claim 12, wherein the frequency reflecting unit is a wave absorbing unit.

16. A frequency reflecting unit with a three-dimensional structure, used as a portion of a frequency reflector, the frequency reflecting unit comprising:

a three-dimensional metal pattern disposed on a metal layout layer defined on one side of the frequency reflecting unit; the three-dimensional metal pattern comprises a plurality of metal conductors;

wherein a portion of the plurality of metal conductors extends downwards from a periphery of the metal layout layer and is an open circuit, and at least one of the plurality of metal conductors forms a non-zero angle with said metal layout layer;

wherein the metal pattern comprises a plurality of metal conductors, each of the plurality of metal conductors extending inwards from a periphery of the metal pattern, a long side of the metal conductor being disposed on the periphery corresponding thereto.

* * * * *